US005762143A

United States Patent [19]

Comeau et al.

[11] Patent Number: 5,762,143

[45] Date of Patent: Jun. 9, 1998

[54] SYSTEM AND METHOD FOR PLACEMENT AND RETRIEVAL OF A SUBSURFACE DIVERTING TOOL USED IN DRILLING AND COMPLETING WELLS

[75] Inventors: Laurier E. Comeau, Leduc; Elis Vandenberg, Sherwood Park; Ian Gillis, Leduc, all of Calif.

[73] Assignee: Baroid Technology, Inc., Houston, Tex.

[21] Appl. No.: 654,988

[22] Filed: May 29, 1996

[51] Int. Cl.[6] ..... E21B 7/06

[52] U.S. Cl. ..... 166/381; 166/117.6

[58] Field of Search ..... 166/50, 117.6, 166/313, 117.5, 381

[56] References Cited

U.S. PATENT DOCUMENTS

| | | | |
|---|---|---|---|
| 4,765,404 | 8/1988 | Bailey et al. | 166/117.6 |
| 5,109,924 | 5/1992 | Jürgens et al. | 166/117.5 |
| 5,277,251 | 1/1994 | Blount et al. | 166/117.5 |
| 5,301,760 | 4/1994 | Graham . | |
| 5,322,127 | 6/1994 | McNair et al. . | |
| 5,335,737 | 8/1994 | Baugh | 166/117.6 X |
| 5,411,082 | 5/1995 | Kennedy | 166/181 |
| 5,425,419 | 6/1995 | Sieber | 166/117.6 X |
| 5,439,051 | 8/1995 | Kennedy et al. . | |

FOREIGN PATENT DOCUMENTS

| | | |
|---|---|---|
| 0 353 962 A2 | 7/1989 | European Pat. Off. . |
| 0 442 675 A2 | 2/1991 | European Pat. Off. . |
| 2 227 038 | 7/1990 | United Kingdom . |
| 2 258 479 | 2/1993 | United Kingdom . |

OTHER PUBLICATIONS

Weatherford Fishing and Rental Tools, "Whipstocks and Whipstock Mills" brouchure, published Dec. 1994 by Weatherford International Incorporated, P.O. Box 27608 Houston, Texas 77227.

Front and back cover and pp. 2826–2830 of the TIW 1994–95 General Catalog, published 1993 by TIW Corporation, P.O. Box 35729, Houston, Texas 77235.

*Primary Examiner*—Frank Tsay

*Attorney, Agent, or Firm*—Browning Bushman

[57] ABSTRACT

A diverting tool having a deflecting surface is equipped with an anchor that secures the tool at a desired subsurface location within the casing of a primary well bore to divert drilling equipment used to drill a lateral bore. An annular cup-type seal on the tool seals with the casing. A passage through the tool permits fluid bypass across the seal as the tool is lowered through the casing. The passage is closed from the well surface when the tool is anchored. After the lateral bore is drilled, the tool is used to divert a liner into the lateral bore. The upper end of the liner extends into the casing where it is centralized. The liner is cemented in the lateral bore and in the casing with the cement placed to effect sealing of the intersection of the liner and casing. A tubular mill removes the cement and liner from the casing above the diverter tool leaving a flush opening from the casing into the liner. The mill then telescopes over the deflecting surface, mills the swab-cup seal to disrupt the tool's seal with the casing, locks on to the tool and releases the tool from the casing for retrieval of the combined assembly to the well surface. The tool may be repositioned within the casing to divert tools into the liner.

17 Claims, 3 Drawing Sheets

FIG. 8
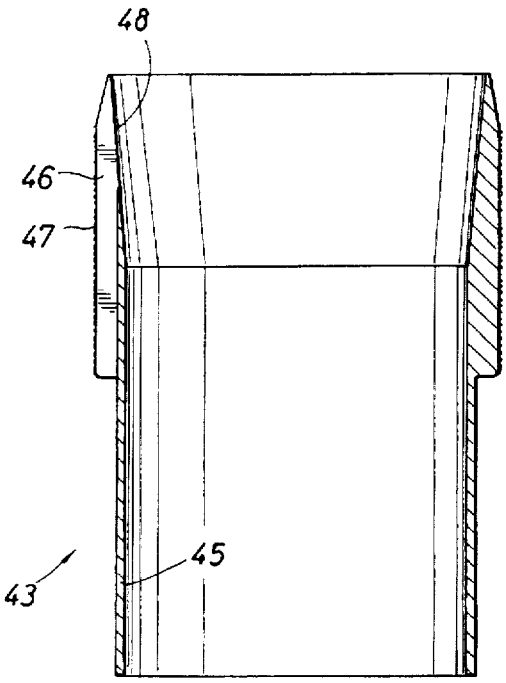
FIG. 6
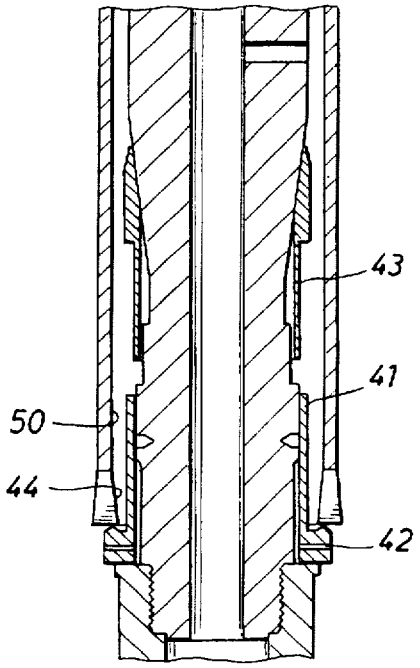
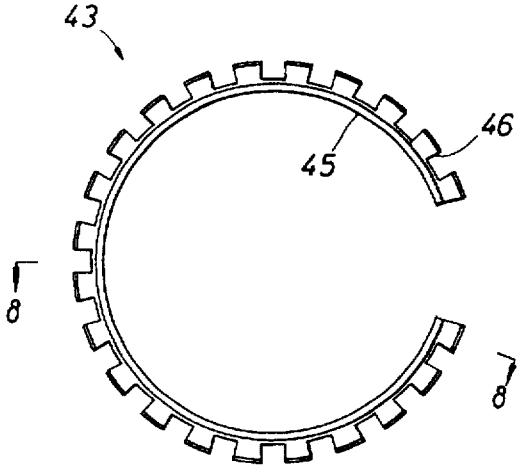
FIG. 7

SYSTEM AND METHOD FOR PLACEMENT AND RETRIEVAL OF A SUBSURFACE DIVERTING TOOL USED IN DRILLING AND COMPLETING WELLS

FIELD OF THE INVENTION

The present invention relates generally to the drilling and completion of lateral well bores that are formed from a primary well bore.

BACKGROUND OF THE INVENTION

Typically, lateral bore holes are drilled from a main well bore with the assistance of a diverting tool that is anchored in the main bore and functions to divert a drill bit from the main bore into the formation alongside the main bore. A variety of devices and techniques have been employed to position and anchor the diverting tool so that it diverts the drill bit at the appropriate location and in the correct direction.

The mechanisms used to anchor and release the subsurface diverting tool have been relatively complex and some have required complicated surface manipulations to anchor and release them from their positions within the well bore. Placement of the diverting tools is also difficult when the tool is required to seal with the well bore within which it is anchored. If the seal occurs before the tool has been lowered into place, the subsurface tool can function as a sealed piston moving through the well casing, which causes a pressure lock to occur. To prevent development of this pressure lock, subsurface devices have generally included mechanisms for effecting a seal only after the tool has been lowered to the desired subsurface location.

Subsurface tools that are designed to be operated from the well surface to anchor and seal a well casing usually employ radially movable mechanisms to engage and seal with the casing. These mechanisms, which generally must be in a retracted position to permit the tool to move through the casing, are actuated from the well surface once the tools have been properly positioned at the appropriate subsurface location. Extension and retraction of these anchoring and sealing devices generally involve the use of relatively complex mechanisms that must be manipulated in a specific sequence or subjected to pressure controls applied from the well surface. The complexity of these devices makes them expensive to construct and increases the likelihood of their failure during the setting and retrieving sequences.

Retrieval of anchored mechanisms also frequently requires the use of complicated release mechanisms that are expensive to manufacture and maintain and may easily malfunction. Where a milling operation is involved, it may also be necessary to perform one or more cleaning procedures before the anchored mechanisms may be retrieved. These additional procedures can add significantly to the time and associated expense required to drill or complete the well.

SUMMARY OF THE INVENTION

The invention is an improvement in a subsurface diverter tool designed to be lowered down through a main well casing, anchored in position at a desired subsurface location within the casing and subsequently retrieved to the well surface. A millable annular cup-type seal is employed on the tool to form a continuous sliding seal with the well casing. A fluid flow passage is provided in the tool to bypass pressure across the annular seal while the tool is being lowered into position. Once the tool is in position, the bypass may be closed from the well surface so that the tool completely seals the casing. Use of a constantly engaged annular seal provides the desired sealing effect with the surrounding casing without the need for complicated remotely actuated annular sealing mechanisms.

The tool is retrieved by a milling tool that performs the multiple functions of clearing the casing bore down to the well tool, disrupting the annular seal, engaging and securing the tool and releasing the tool from its anchored setting. The disruption of the annular seal ensures that pressure will equalize across the tool as it is being retrieved to the well surface to prevent a pressure lock thereby avoiding the need for complex valve reopening mechanisms or remote surface operations as commonly required with many conventional retrievable tools.

Another feature of the invention is that the connection of the milling tool to the well tool is effected by simple axial movement of the tools toward each other. The design of the retrieving mechanism of the present invention thus contributes to its ease of use, certainty of proper operation and low cost of fabrication.

The design of the system and method of the present invention also provides a single trip procedure for reopening the main casing and engaging and retrieving the well tool. Once the mill and attached well tool are retrieved, the contents of the tubular mill can be examined to confirm proper milling out of the materials in the main well casing above the anchored tool.

An object of the present invention is to provide a retrievable subsurface tool that may be positioned at a subsurface location in anchoring and sealing engagement with the casing and thereafter be released and retrieved to the well surface with a simple mechanical retrieving tool.

A related object of the invention is to provide a retrievable subsurface tool that is simple in construction and operation to reduce its fabrication costs and to reduce the possibility of component failure or malfunction.

It is an object of the present invention to provide a retrievable subsurface tool that forms a seal with the casing wall using a fixed annular seal that remains in sealing contact with the casing wall during placement and operation of the tool.

It is a further object of the present invention to provide a subsurface tool equipped with a bypass flow passage extending across the fixed annular seal to prevent pressure differentials from developing across the tool as it is moved through the casing. Another object of the invention is to provide a subsurface tool that will close the fluid bypass when actuated from the surface to completely plug the well casing.

It is also an object of the invention to provide a retrievable diverter tool that is retrieved by a mill that disrupts the sealing engagement of the tool with the casing, attaches to the tool, and releases the tool from its anchored condition to permit retrieval of the combined assembly to the well surface.

A further object of the invention is to centralize the upper end of a lateral liner that is contained within the primary well casing so that the milling tool can telescope over the end of the liner as it mills through the cement down to a diverter tool to thereby aid in centralizing the bore being milled within the main well casing.

These and further objects, features and advantages of the present invention will become apparent from the following detailed description, wherein reference is made to the figures in the accompanying drawings.

BRIEF DESCRIPTION OF THE DRAWINGS

FIG. 6 is a view similar to FIG. 5 illustrating the gripping mechanism being released by the mill;

FIG. 7 is a plan view illustrating details in the construction of the gripping mechanism employed to secure the deflecting tool to the mill; and FIG. 8 is a detailed view of the gripping mechanism taken along the line 8—8 of FIG. 7.

DETAILED DESCRIPTION OF A PREFERRED EMBODIMENTS

Figure 1:
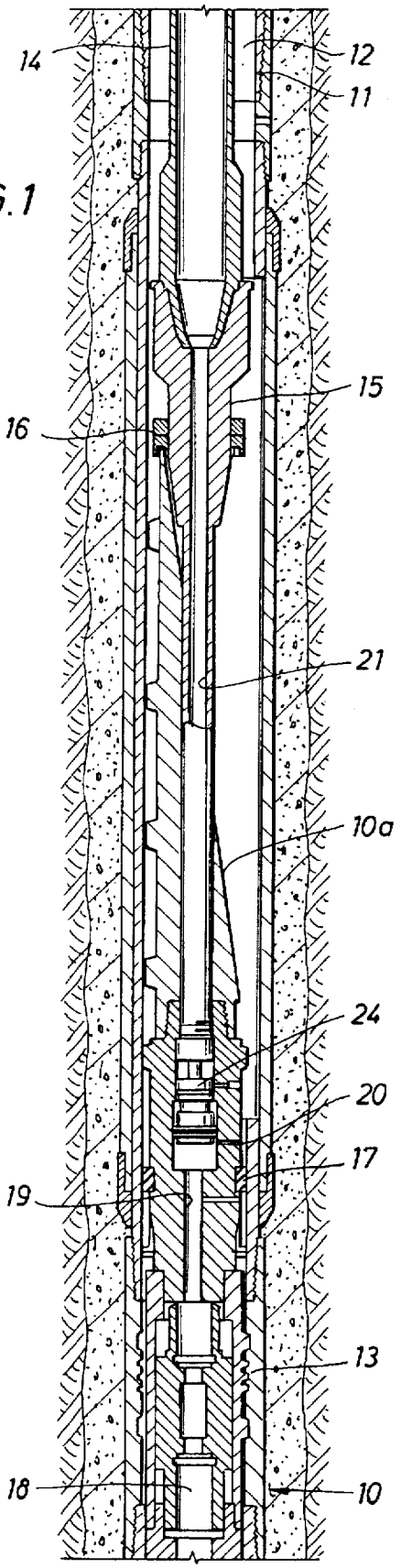
FIG. 1 is an elevation, in section, illustrating a diverting well tool of the present invention being positioned at a subsurface location within a cased primary well bore.

The diverter tool of the present invention, indicated generally at 10, is illustrated being lowered through the casing 11 of a primary well bore 12. The tool 10 includes a tapered diverting surface 10*a*. A specially profiled landing collar 13, which forms part of the primary casing string, is adapted to mate with and to orient and anchor the tool 10 as more fully described in copending application Ser. No. 08/302,714 filed Jun. 22, 1995, and assigned to the assignee of the present application.

The tool 10 is lowered through the well bore 12 by a drill-pipe running string 14 that extends to the well surface. A diverter running tool 15 secures the drill string to the diverter tool with a releasable connector 16 that is severed once the tool 10 has been properly oriented, anchored and sealed.

The tool 10 is used to provide a kickoff or diverting point for a directional drill and is also used to seal the well casing area above the tool from the casing area below the tool. When thus anchored and sealed, the tool functions to retain cuttings and drilling fluids as well as cement in the area above the tool and to prevent well fluids in the area below the tool from contaminating or interfering with the well operations.

During the lowering of the tool 10 through the casing 11, an upwardly facing annular cup-type seal 17 forms a continuous sliding and sealing engagement with the internal casing wall. Fluid is bypassed through the tool 10 across the seal 17 through a central flow passage 18 comprised of an axial passage 19 connecting with a radial passage 20. The seal 17 may be of conventional "swab-cup" design that constantly engages and seals with the surrounding well tube. Such seals increase their sealing effectiveness when energized by a pressure differential.

Figure 2:
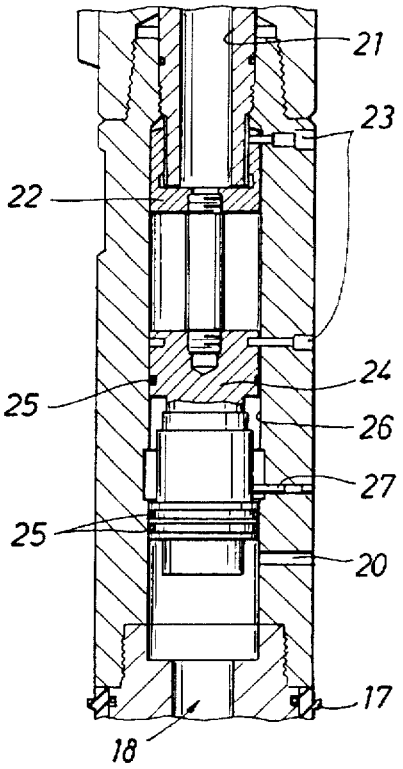
FIG. 2 is a detailed view, in a cross sectional elevation, illustrating the bypass valve of the diverting tool of the present invention in its open position.
Figure 3:
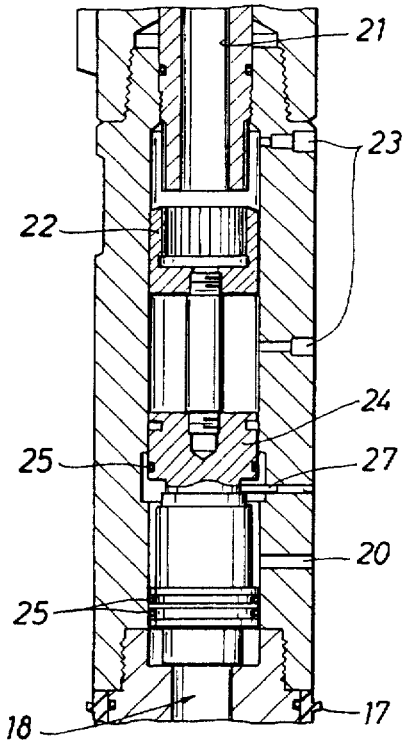
FIG. 3 is a view similar to FIG. 2 illustrating the bypass valve of the diverting tool of the present invention in its closed position.

When the tool 10 is properly landed and oriented in the sleeve 13, control fluid pressure is applied through the drill string 14 to a central flow tube 21 to close the flow passage 18. To this end, as best illustrated in FIG. 2, fluid pressure is applied in the tube 21 to exert an axially directed force against a tube cap 22 to shear pins 23 restraining a bypass valve piston 24. The piston 24 is equipped with o-ring seals 25 that provide a sliding sealing engagement with the wall of the surrounding piston bore 26. Once the pins 23 shear, the fluid pressure drives the valve piston 24 down to the position illustrated in FIG. 3 to close the radial bypass port 20. Movement of the piston into the position illustrated in FIG. 3, permits a resilient lock ring holder 27 to snap closed to hold the piston in place. The closing of the port 20 prevents flow through the central tool passage 18 while the annular seal 17 prevents flow externally of the tool so that the well casing 11 is completely sealed by the tool 10. Once sealed within the casing 11, the tool 10 functions to prevent cuttings, drilling and treating fluids and cement or other debris from moving down through the well casing 11 and also prevents well fluids below the tool from flowing into the casing above the tool.

After the tool 10 is oriented, anchored and sealed, a conventional lateral drilling operation is performed to form a lateral well bore 28 (FIG. 4) through a window 30 formed in the main casing 11. Details in the formation of the well bore 28, window 30 as well as the equipment and procedure employed in orienting and anchoring the diverter tool 10 are more fully described in the aforementioned copending U.S. patent application.

Following formation of the lateral bore 28, liner 31 is positioned in the lateral bore 28 using the diverter tool 10 to direct the liner from the main bore to the lateral bore in a conventional manner. The upper end (not illustrated) of the liner 31 is allowed to extend a short distance into the main casing 11 where it is centralized with millable centralizing pads, the remnants of such pads being illustrated at 32 in FIG. 4.

The liner 31 is cemented in the lateral bore 28 with the cement also being applied to the space between the liner and the casing 11 as illustrated at 33 and into the intersection 38 of the liner bore and main bore as illustrated at 34. Use of the centralizing pads 32 ensures that the cement will fill in uniformly around the upper end of the liner 31. It will be appreciated that the pads 32 extend around the outer circumference of the liner 28 and are equipped with axially extending bypass openings (not illustrated) to enable the cement to flow past the pads into the annular areas between the liner and the casing 11. The cement functions to seal the intersection of the upper end of the liner with the main bore casing as well as to seal the upper end of the liner centrally within the main casing.

Figure 4:
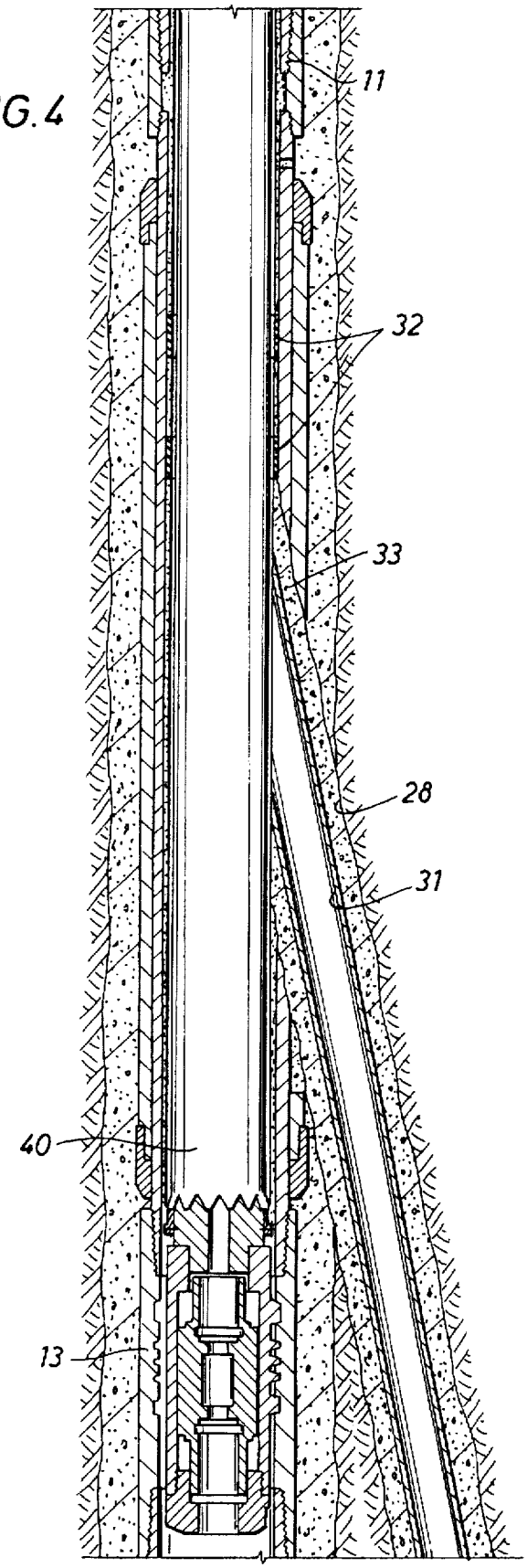
FIG. 4 is an elevation, in section, illustrating the washover retrieving mill portion of the present invention telescoped over the diverting tool in preparation for releasing and retrieving the diverter tool.

Following the cementing operation, a tubular overshot mill retrieving tool 40 is used to mill out the cement in the main bore as illustrated in FIG. 4. The outside diameter of the base of the mill 40 is slightly smaller than the inside diameter of the casing 11 so that only a thin layer of cement is left between the mill and the casing as the mill advances downwardly. The mill 40 telescopes over the upper end of the liner and is used to mill through the liner at the point the liner enters the main casing. The tubular mill 40 extends axially sufficiently to provide the necessary internal volume and length to completely envelope the cement, cuttings and other debris remaining in the well casing above the set tool 10 as well as telescope over the body of the tool 10 as required to engage and then release the tool from its anchored position within the casing.

Figure 5:
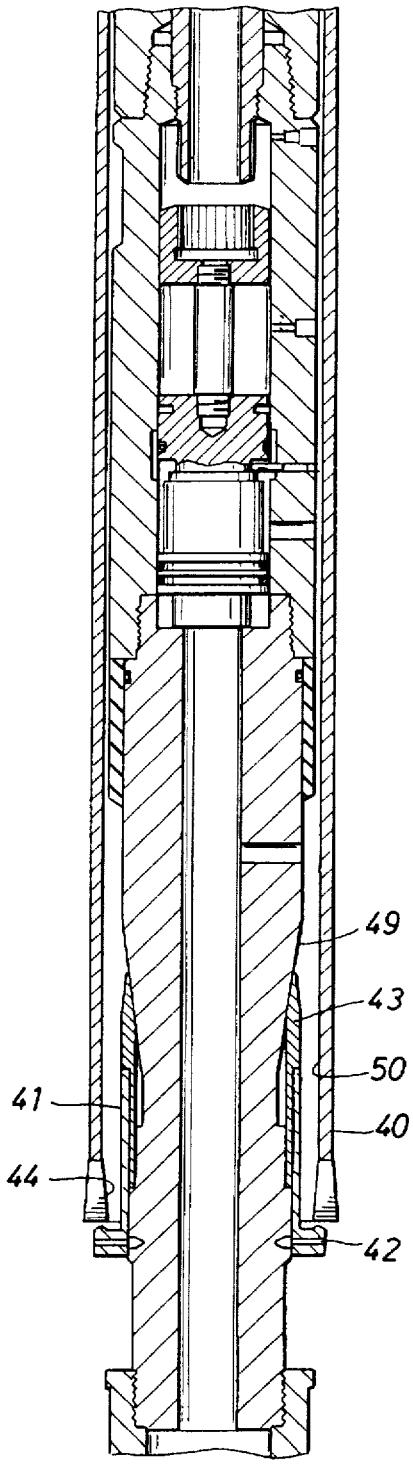
FIG. 5 is an elevation, in section, illustrating details in the operation and construction of the gripping mechanism employed to secure the retrieving mill to the diverter tool.

FIG. 5 illustrates the mill 40 telescoped over the upper end of the tool 10 in preparation for releasing and retrieving the tool 10. As the mill advances over the tool 10, the seal 17 is milled away and a retaining collar 41 is then pushed down into the position illustrated in FIG. 6. The destruction of the seal 17 by the mill opens an annular bypass around the tool 10 to permit pressure equalization across the tool.

Pushing the collar 41 down sheers retaining pins 42 holding the collar 41 in place. With the collar 41 pushed down, a compressed steel gripping mechanism 43 springs open so that it will be engaged by an internally restricted lip area 44 formed within the lower end of the mill 40. As best illustrated in FIG. 7, the gripping mechanism 43 has a tubular base section 45 supporting a number of axially extending wedge fingers 46. The base section is partially cut away to form an incomplete circle so that the mechanism 43 may be compressed radially. The fingers 46, which are developed radially outwardly from the base section, are provided with teeth 47 on their extended outer surfaces. The upper ends of the fingers 46 have an internally tapered bearing surface 48.

With the mill 40 in the position illustrated in FIG. 5, the wedge gripping mechanism 43 remains retained in its radially constricted configuration by an upper sleeve section of the retaining collar 41. The mill 40 may telescope freely over the constricted mechanism 43 until the base of the mill engages the enlarged base of the retaining collar 41. Continued lowering of the mill pushes the collar 41 down and frees the mechanism 43 to spring radially open. Thereafter, the mill 40 is pulled back up so that the inner constriction 44 engages the fingers 46 of the mechanism 43 and draws the fingers up against an externally tapered spreading surface 49 on the body of the tool 10.

The upward movement of the fingers 46 over the spreading surface 49 causes the fingers to spread radially outwardly into engagement with a cylindrical internal surface 50 of the mill 40. The tapered bearing surfaces 48 of the fingers cooperate with the tapered spreading surface 49 to force the finger teeth 47 into firm gripping engagement with the internal mill surface 50 as the mill 40 is pulled up axially relative to the tool 10. The resulting gripping force between the tool 10 and mill 40 permits the tool to be released from the casing and retrieved to the well surface with the mill.

In the operation of the system and method of the present invention, the diverting tool 10 is attached to a drill string and lowered into the casing 11 that has been cemented into the well bore 12. The well casing 11 is preferably equipped with a special casing collar 13 having a uniquely profiled internal surface that mates with a corresponding profile in a setting mechanism carried at the base of the tool 10. The collar cooperates with the setting mechanism to securely anchor and orient the tool 10 relative to a preformed casing window 30 through which a lateral bore 28 is to be drilled. As the tool 10 is lowered through the casing 11, the annular cup-type seal 17 engages and forms a sliding seal with the internal surface of the casing 11. During this lowering process, well fluids are bypassed across the annular outer seal 17 through a central bypass flow passage 18 that extends through the tool 10. The upward orientation of the cup seal also contributes to fluid bypass across the tool as it is being lowered through the casing in that any relatively high pressure developing below the tool tends to collapse the cup seal so that pressure may equalize across the tool. Once the tool is latched and oriented within the collar 13, pressure applied through the drill string 14 shifts the central bypass valve piston 24 down to close the bypass flow passage 18.

The setting tool 15 that connects the diverter tool 10 to the drill string 14 is released from the diverter tool by severing a shear pin or by another conventional release method. A drill string and bit (not illustrated) are then employed in conventional fashion to divert from the diverting surface **10*a* of the tool 10 through the casing window 30 into the surrounding earth formation to form the lateral well bore 28. During this lateral bore drilling process, the drilling fluids, drill bit cuttings, treating and completion chemicals and any other materials present in the operation are retained in the casing above the sealed tool 10**.

The drill string and bit are retrieved to the surface after the lateral bore 28 is completed. The liner 31 is then lowered into the well through the main casing 11 down to the deflecting face **10*a* of the diverter tool 10 where the tool 10 diverts the lower end of the liner into the bore hole 28. The liner is inserted into the lateral bore hole 28 with the upper end of the liner (not illustrated) allowed to protrude into and extend for a short distance upwardly through the main casing. The centralizing pads 32 ensure that the protruding upper end of the liner is centralized within the casing 11**.

The liner 31 is cemented into the lateral bore 28 using conventional cementing equipment and procedures. Sufficient cement is also introduced during this procedure to fill the void between the liner 31 and the intersection area of the liner with the main casing string 11 as well as the annular area between the protruding upper end of the liner and the casing 11 and between the tool 10 and the casing 11 in the area above the seal 17.

The tubular retrieving mill 40 is secured to the bottom of a drill string and is rotated and lowered to mill over the upper liner end and the cement, down to the tool 10. This process produces a smooth internal bore through the casing 11 with a flush sealing interface, comprising cement and the liner end surface, at the intersection of the liner 31 with the internal casing wall. After milling through the cement and cutting through the liner 31 at its entry into the casing 11, the mill continues to cut cement as it telescopes over the deflecting face **10*a* of the tool. This downward milling procedure is continued until the seal 17 is destroyed and the lower end of the mill engages and shifts the retaining collar 41 down to the position illustrated in FIG. 6 to release the fingers 43. Raising the mill 40 after the collar 41 is shifted down pulls the released gripping fingers 43 against the spreading surface 49, which wedges the tool 10 and the mill 40 together. As thus held together, the entire assembly of mill 40 and tool 10 may be released from the locking collar 13 and retrieved to the well surface. The absence of the seal 17** prevents a pressure lock from developing across the assembly as it is retrieved.

At the completion of the described process, the well is reopened with a substantially smooth, substantially full bore opening through the intersection of the lateral and main casing. The cement at the intersection functions to seal the liner to the internal casing area and to hold the lateral liner in place.

The diverter tool 10 may be rerun to reposition it in the latch collar 13 as required to divert tools or other materials from the casing 11 into the liner 31.

The foregoing disclosure and description of the invention is illustrative and explanatory thereof. It will be appreciated by those skilled in the art that various changes in the size, shape and materials, as well as in the details of the illustrated construction. The combinations of features and the method steps discussed herein may be made without departing from the spirit of the invention.

What is claimed is:

1. Apparatus for temporarily anchoring within and sealing a well pipe at a subsurface location comprising:

an anchor for engaging and mechanically holding said apparatus stationary within said well pipe at a desired subsurface well location;

a primary seal for forming a partial seal between said apparatus and said well pipe;

a selectively closeable fluid bypass for allowing pressure equalization across said primary seal while said apparatus is being moved through said well pipe;

a closure mechanism operable when said apparatus is at said desired subsurface location for closing said bypass to completely seal said well pipe; and a retrieving mechanism for milling said primary seal and securing said apparatus for retrieval to the well surface.

2. An apparatus as defined in claim 1, further comprising:

a gripping assembly having radially movable gripping elements carried by said apparatus;

a movable release control for holding said gripping elements at a radially retracted position, said release control being operable by said retrieving mechanism whereby movement of said release control by said retrieving mechanism causes said gripping elements to extend radially into gripping contact with said retrieving mechanism; and a tapered bearing surface acting on said gripping elements to increase the radially directed gripping force of said gripping elements as the tapered bearing surface is moved axially relative to said gripping elements.

3. An apparatus as defined in claim 1, wherein said apparatus includes a diverting surface for directing equipment laterally away from the central axis of said well pipe.

4. An apparatus as defined in claim 1, wherein said primary seal comprises an annular cup-type seal.

5. An apparatus as defined in claim 3, wherein said primary seal comprises an annular cup-type seal.

6. An apparatus as defined in claim 4, wherein said retrieving mechanism comprises an elongate tubular mill.

7. An apparatus as defined in claim 6, wherein said retrieving mechanism further comprises a gripping assembly having radially movable gripping elements carried by said apparatus;

a movable release control for holding said gripping elements at a radially retracted position, said release control being operable by said retrieving mechanism whereby movement of said release control by said retrieving mechanism causes said gripping elements to extend radially into gripping contact with said retrieving mechanism; and a tapered bearing surface acting on said gripping elements to increase the radially directed gripping force of said gripping elements as the tapered bearing surface is moved axially relative to said gripping elements.

8. An apparatus as defined in claim 3, wherein said retrieving mechanism further comprises:

a tubular milling device for disrupting said primary seal and securing said device for retrieval to the well surface.

9. An apparatus as defined in claim 8, further comprising:

a releasable gripping assembly carried by said apparatus;

said retrieving mechanism adapted to engage and connect with said gripping assembly to release said assembly from said desired subsurface well location;

said gripping assembly having radially movable gripping elements held at a radially retracted position on said apparatus by a movable release control, said release control being operable by said retrieving mechanism whereby movement of said release control by said retrieving mechanism causes said gripping elements to extend radially into gripping contact with said retrieving mechanism; and a tapered bearing surface carried by said retrieving mechanism and acting on said gripping elements to increase the radially directed gripping force of said gripping elements as the tapered bearing surface is moved axially relative to said gripping elements.

10. A device for selectively holding and releasing components in an axially extending subsurface well apparatus comprising:

a gripping assembly having radially movable gripping elements carried by said apparatus;

a retrieving mechanism adapted to engage and connect with said gripping assembly to release said assembly from an engaged position in said apparatus;

a movable release control for holding said radially movable gripping elements at a radially retracted position on said apparatus, said release control being operable by said retrieving mechanism whereby movement of said release control by said retrieving mechanism causes said gripping elements to extend radially into gripping contact with said retrieving mechanism; and a tapered bearing surface acting on said gripping elements to increase the radially directed gripping force of said gripping elements as the tapered bearing surface is moved axially relative to said gripping elements.

11. A device as defined in claim 10, wherein:

said retrieving mechanism comprises a tubular body adapted to telescope over said gripping elements; and said release control comprises an annular retainer encircling said gripping elements to retain said gripping elements in said radially retracted position until moved by said retrieving mechanism.

12. A device as defined in claim 11, wherein said gripping elements move radially outwardly when released to be engaged by an internal tubular surface of said retrieving mechanism and movement of said retrieving mechanism axially relative to said tapered bearing surface draws said gripping elements against said tapered bearing surface to increase the radially directed gripping force exerted by said gripping elements against said internal tubular surface of said retrieving mechanism.

13. A subsurface, retrievable deflection apparatus for deflecting equipment laterally from a main well bore comprising:

a surface operated latching mechanism for securing said deflection apparatus at a subsurface location within the main well bore;

a diverting surface on said deflection apparatus for directing equipment laterally away from the central axis of the main well bore;

an orienting device connected with said deflection apparatus for orienting said diverting surface relative to the circumference of the main well bore;

an annular swab-cup type seal carried by said deflection apparatus for sealing the annular space between said deflection apparatus and the main well bore;

a fluid bypass extending axially through said deflecting apparatus for bypassing pressure axially through said deflecting apparatus across said annular seal; and a surface controlled bypass closure mechanism for closing said fluid bypass.

14. A method of placing and retrieving a subsurface tool in a subsurface location within a well tube comprising the steps of:

lowering said tool having a wiper seal to a subsurface location within said well tube, said wiper seal being adapted to slidingly seal with said well tube;

bypassing pressure across said wiper seal through an axially extending flow passage provided in said tool while said tool is being lowered through said well tube;

anchoring said tool to said well tube at said subsurface location within said well tube;

closing said flow passage to prevent pressure bypass across said tool and wiper seal;

lowering a retrieving mechanism through said well tube and into gripping engagement with said tool;

disrupting said wiper seal with said retrieving mechanism to permit pressure bypass across said tool;

releasing said tool from anchored condition with said well tube; and retrieving said retrieving mechanism and gripped tool to the well surface.

15. A method as defined in claim 14, further comprising the steps of:

providing a diverting surface on said tool for diverting equipment lowered into said well tube away from the central axis of said well tube.

16. A method as defined in claim 15, further comprising the steps of:

lowering a drilling assembly into said well tube; and diverting said drilling assembly with said diverting surface for drilling a lateral well bore.

17. A method as defined in claim 15, further comprising the steps of orienting said subsurface tool in said well tube for facing said diverting surface to a predetermined circumferential location in said well tube.

* * * * *